US007124886B2

(12) United States Patent
Heidenreich

(10) Patent No.: US 7,124,886 B2
(45) Date of Patent: Oct. 24, 2006

(54) GOLF CLUB HOLDER

(76) Inventor: David C. Heidenreich, 3105 Wren La., Richardson, TX (US) 75082

( * ) Notice: Subject to any disclaimer, the term of this patent is extended or adjusted under 35 U.S.C. 154(b) by 21 days.

(21) Appl. No.: 10/455,654

(22) Filed: Jun. 5, 2003

(65) Prior Publication Data

US 2004/0245133 A1 Dec. 9, 2004

(51) Int. Cl.
*A63B 55/00* (2006.01)
*A63B 55/04* (2006.01)
*A63B 55/06* (2006.01)

(52) U.S. Cl. ..... 206/315.2; 206/315.3; 206/315.6; 211/70.2

(58) Field of Classification Search ..... 211/70.2; 206/315.2, 315, 315.6, 315.3, 818
See application file for complete search history.

(56) References Cited

U.S. PATENT DOCUMENTS 3,503,518 A * 3/1970 Black ..... 211/70.2
3,805,428 A * 4/1974 Yanagawa ..... 353/27 R
4,111,248 A * 9/1978 Leichhardt ..... 206/315.6
4,200,131 A * 4/1980 Chitwood et al. ..... 206/315.6
4,673,082 A * 6/1987 Hemme ..... 206/315.6
4,753,344 A * 6/1988 Antonious ..... 206/315.3
4,753,446 A * 6/1988 Mills ..... 280/47.18
4,919,279 A * 4/1990 Crump ..... 211/70.2
4,960,212 A * 10/1990 Wu ..... 211/70.2
5,188,243 A * 2/1993 Ruiz ..... 211/70.2
5,228,566 A * 7/1993 Shenoha ..... 206/315.6
5,238,109 A * 8/1993 Smith ..... 206/315.2
5,636,734 A * 6/1997 Smith ..... 206/315.2
D384,504 S * 10/1997 Christie ..... D3/320
5,755,322 A * 5/1998 Yang ..... 206/315.2
5,779,043 A * 7/1998 Hsu et al. ..... 206/315.6
5,964,346 A * 10/1999 O'Connor ..... 206/315.6
5,984,395 A * 11/1999 Halpen ..... 294/143
6,138,825 A * 10/2000 Summerlin ..... 206/315.6
6,343,692 B1 * 2/2002 Park ..... 206/315.2
6,352,154 B1 * 3/2002 Miura ..... 206/315.6
6,536,588 B1 * 3/2003 Kyrwood ..... 206/315.6
6,575,311 B1 * 6/2003 Fink ..... 211/70.2
2001/0000108 A1 * 4/2001 Perry
2003/0192797 A1 * 10/2003 Man ..... 206/315.3
2004/0055343 A1 * 3/2004 Mahre et al. ..... 70/58

* cited by examiner

*Primary Examiner*—Sue A. Weaver
(74) *Attorney, Agent, or Firm*—Thrasher Associates

(57) ABSTRACT

The invention is a golf club holder. The golf club holder comprises of at least one flute coupled to a golf club support via a generally horizontal arm. The flute has an inner surface that has at least one magnet to secure a golf club shaft within the flute. The flute is any structure that accepts a golf club shaft. The golf club support is any structure that is adapted to hold a golf club head and that prevents a golf club head from chaffing and scratching against another golf club or other items found in the golf club bag.

18 Claims, 2 Drawing Sheets

GOLF CLUB HOLDER

TECHNICAL FIELD

The invention relates to golfing, and, more particularly, the invention relates to golf bags.

STATEMENT OF A PROBLEM ADDRESSED BY THIS INVENTION

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Statement of a Problem Addressed by This Invention is to be construed as prior art Discussion Golf clubs are usually carried in open-topped golf bags that receive inverted golf clubs for easy identification and access thereto. Typically, this opening has dividers or orifices for dividing the golf bag top into different sections or compartments. It is typical for a golfer, who commonly has an excess of clubs, to store clubs in each compartment. This can lead to difficulty in finding a particular club, especially when dealing with clubs of a similar size and shape. Another problem with this arrangement is that it allows golf clubs to move freely in the openings of the bag, so that the golf clubs become entangled. In addition, such openings lack organization, and so golfers may access or even use the wrong club. Furthermore, when jostled, the clubs are free to strike one another, which can damage the (typically expensive) golf clubs.

Golf club holders do exist that organize and protect golf clubs from damage and entanglement however, all have been unsuccessful at organizing and securing a set of golf clubs within a golf club bag, preventing scuffing, chipping, and "club chatter" as a bag is carried or is whisked over a bump on the back of a motorized golf cart.

SELECTED OVERVIEW OF SELECTED EMBODIMENTS

The invention provides technical advantages as a golf club holder that is adapted to secure at least one golf club within a golf club bag. This golf club holder is preferably fastened to a golf bag and has structure that prevents a golf club from chaffing and scratching against another golf club or other items in the golf club bag.

In one embodiment, the golf club holder secures at least one golf club within a golf club bag by using magnetism. The golf club holder comprises at least one flute coupled to a golf club support in generally vertical alignment with the flute via a generally horizontal arm. Within the cavity of flute, at least one magnet is embedded within a interior surface. The magnet secures a golf club shaft within the golf club holder.

The golf club holder may be fastened to a golf club bag via an adhesive. In an alternative embodiment, the golf club holder could be secured via a clip. Alternatively, the golf club holder may merely rest within the opening of a golf bag. Of course, other means of coupling a golf club holder to a golf bag are readily apparent to those of ordinary skill in the art and their alternatives are incorporated within the scope of the invention.

Of course, other features and embodiments of the invention will be apparent to those of ordinary skill in the art. After reading the specification, and the detailed description of the exemplary embodiment, these persons will recognize that similar results can be achieved in not dissimilar ways. Accordingly, the detailed description is provided as an example of the best mode of the invention, and it should be understood that the invention is not limited by the detailed description. Accordingly, the invention should be read as being limited only by the claims.

BRIEF DESCRIPTION OF THE DRAWINGS

Various aspects of the invention, as well as at least one embodiment, are better understood by reference to the following EXEMPLARY EMBODIMENT OF A BEST MODE. To better understand the invention, the EXEMPLARY EMBODIMENT OF A BEST MODE should be read in conjunction with the drawings in which.

AN EXEMPLARY EMBODIMENT OF A BEST MODE

Interpretation Considerations

Figure 1:
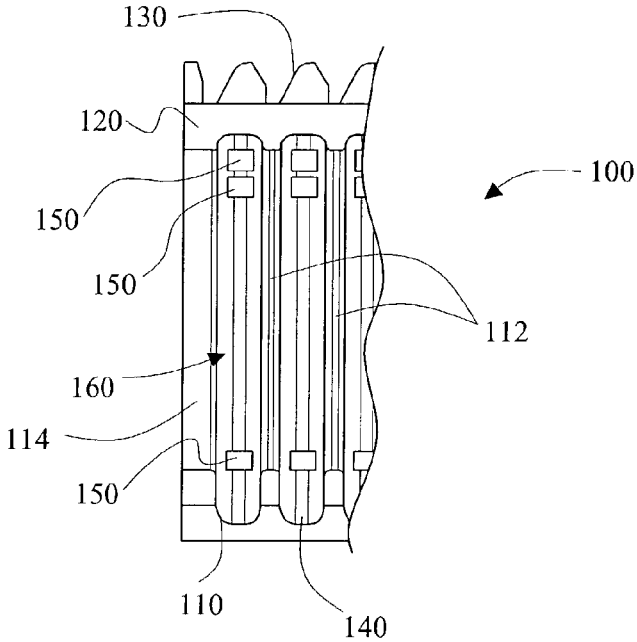
FIG. 1 illustrates a golf club holder flute for securing a golf club to a golf bag.

The invention can be characterized as golf club holder. The golf club holder typically comprises of at least one flute coupled to a golf club support via a generally horizontal arm. The flute has an inner surface that has at least one magnet to secure a golf club shaft within the flute and is any structure that accepts a golf club shaft. The golf club support is any structure that is adapted to hold a golf club head and that prevents a golf club head from chaffing and scratching against another golf club or other items found in the golf club bag.

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus.

Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching"). Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for—functioning—" or "step for—functioning—" in the Claims section.

Discussion of the Figures

Features and advantages of the invention can be better understood by reviewing FIG. 1, which illustrates a golf club holder 100, for securing a golf club to a golf bag. A golf club may be secured to the golf club holder 100 via its shaft. A golf club comprises a head, a shaft, and a grip. The shaft is the longest portion of a golf club that has a grip at one end and the shaft couples to the head at the opposite end. Accordingly, the invention is usable with any golf club shaft made of material that has magnetic attraction properties, such as Iron, Cobalt, Nickel and their alloys, for example. Alternatively, magnetically responsive clips or wraps may be placed about a non-magnetic golf club shaft to allow any golf club shaft to be secured to the golf club holder 100.

The golf club holder 100 comprises a flute 110, a horizontal arm 120, a golf club support 130, an interior surface 140, at least one magnet 150, and a cavity 160. The flute 110 is coupled to the golf club support 130 via the horizontal arm 120. A flute is any structure that accepts a golf club shaft, while being small enough to not accept a golf club head. It may be a single structure, or may comprise multiple parts. In a preferred embodiment, the flute 110 is formed by two opposing generally parallel surfaces, where the area in between the surfaces defines the cavity. Of course, although the interior surface 140 is generally circular as illustrated in FIG. 1, the interior surface 140 could be concave, trihedral, synclined (V-shaped), or prolated (cigar shaped) in shape, (for example) capable of accepting a golf club shaft.

A golf club support 130 is any structure that is adapted to hold a golf club head and prevents the golf club head from swiveling or twisting. In FIG. 1, the golf club support 130 is formed by opposing surfaces with at least one surface generally shaped to form to one surface of a golf club head. The golf club support 130 couples to the generally parallel surfaces 112, 114 via a horizontal arm 120. In practice, the golf club support 130 holds and protects the golf club head from chaffing and scratching against another golf club head or other items found in the golf club bag.

The horizontal arm 120 could have an attachment to secure the golf club holder 100 to a golf bag. The width of the horizontal arm 120 is at least equal to the width of a flute 110. The attachment could be a fastening means such as a, clip, Velcro, bracket, or screw, for example. In another embodiment the golf club holder 100 could be secured to a golf bag portion via an adhesive such as glue, cement, or tape, for example.

In a preferred embodiment, a plurality of magnets 150 forming a column could be secured within the interior surface 140 of a flute 110. In an alternative embodiment, the interior surface 140 has one magnet 150 for securing a golf club shaft within the flute 110.

Figure 2:
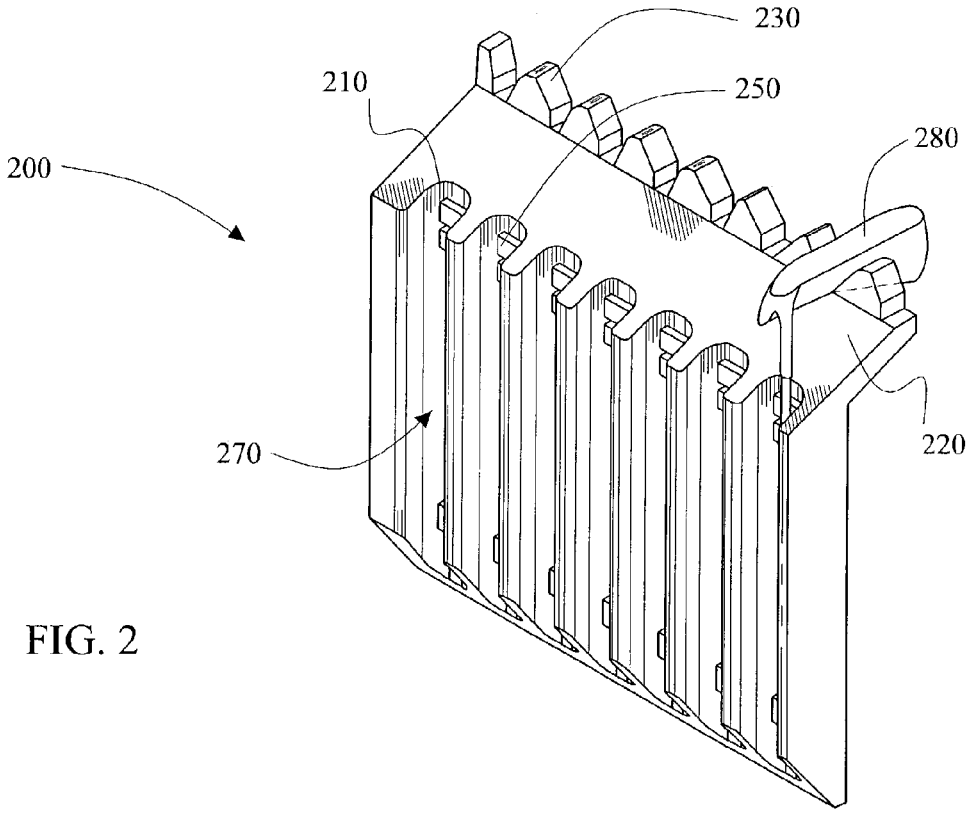
FIG. 2 illustrates a golf club holder for securing a row of golf clubs to a golf bag.

FIG. 2 illustrates a golf club holder 200 that secures at least one golf club 280 in a golf bag portion. The golf club holder 200 comprises a plurality of flutes 210 that traverse a horizontal arm 220, a plurality of golf club supports, one golf club support 230 corresponding with each flute 210. At least one magnet 250 is provided in each flute 210. Of course, a single large magnetic strip may traverse a plurality of flutes to achieve the same results. Each flute 210 is coupled to the horizontal arm 220. In a preferred embodiment, each flute 210 is formed by two opposing surfaces to form a cavity 270. In addition, the number of golf club supports 230 will be equal to the number of golf clubs, commonly 14 clubs, in a golf club set. In an alternative embodiment, the number of golf club supports 230 will be equal to a type of golf clubs, such as irons (7 clubs), for example.

The golf club holder 200 could be formed as a single molded material such as plastic, urethane, or polyethylene, for example. In a preferred embodiment, the row of flutes 210 is equidistant from each other. In an alternative embodiment, the flutes 210 are separated different distances to accommodate more than one size golf club shaft 280, or different sized golf club heads.

Figure 3:
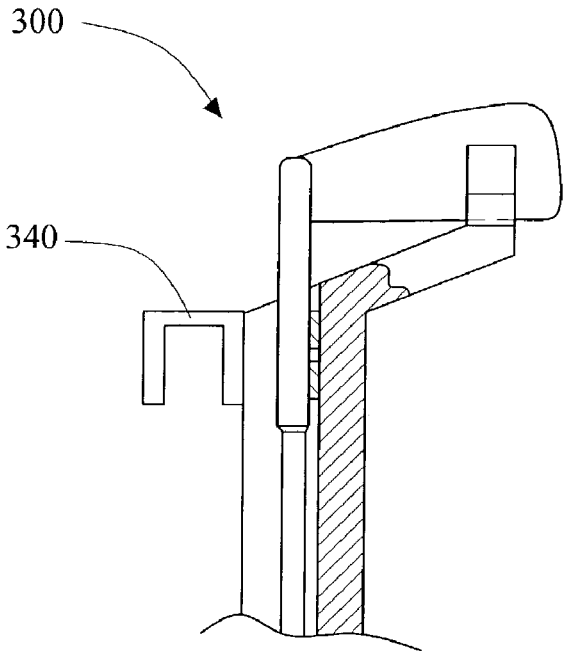
FIG. 3 illustrates the side view of a golf club holder.
Figure 4:
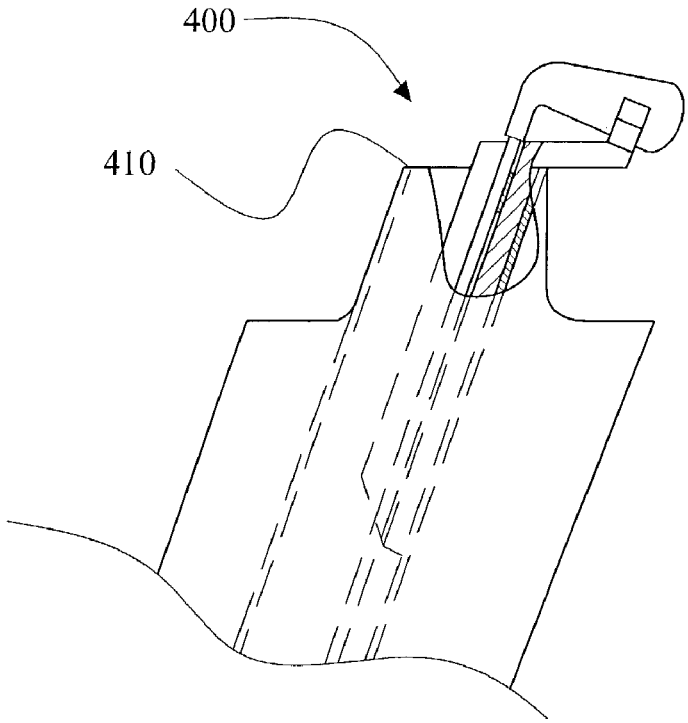
FIG. 4 illustrates one embodiment of a golf club holder secured to the top of a golf bag.

FIG. 3 illustrates a side view of a golf club holder 300. FIG. 3 further details a means 340 for securing the golf club holder 300 to the golf bag. The means for securing 340 may be a removable device such as a clip, bracket, screw, or Velcro, for example. In a preferred embodiment, the golf club holder 300 could be secured to the golf club bag via a permanent fastening means for securing 340 such as glue, cement, tape, or other adhesive apparent to those skilled in the art FIG. 4 illustrates a golf club holder 400 adapted to a golf bag top 410. The golf club holder 400 is secured to a golf bag via a permanent fastening. In a preferred embodiment, the golf club holder 400 could extend across the opening of a golf bag top 410. In an alternative embodiment, the golf club holder 400 could extend a portion of a golf bag top 410.

Thus, though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

What is claimed is:

1. A golf club holder for coupling with the top portion of a golf bag to secure a least one golf club within a golf bag, comprising:

a row of flutes including at least one flute having an interior surface and a top;

at least one magnet coupled to the interior surface;

a golf club support coupled to the top of the flute via a horizontal arm; and the row of flutes is secured to a golf club bag.

2. The golf club holder of claim 1 wherein the flute comprises opposing surfaces.

3. The golf club holder of claim 2 wherein the opposing surfaces are semi-circular, the area within the opposing surfaces defining a cavity.

4. The golf club holder of claim 1 wherein the interior surface is synclined.

5. The golf club holder of claim 1 wherein the interior surface is prolated.

6. The golf club holder of claim 1 wherein the interior surface is trihedral.

7. The golf club holder of claim 1 wherein at least two magnets are embedded within the interior surface.

8. The golf club holder of claim 1 wherein the golf club support comprises opposing surfaces, with at least one surface shaped to form to one surface of a golf club head.

9. The golf club holder of claim 1 wherein the golf club support is for holding and protecting a golf club from chafing on and scratching against another golf club.

10. The golf club holder of claim 1 wherein the width of the horizontal arm is at least equal to the width of a flute.

11. The golf club holder of claim 1 wherein the golf club support and the horizontal arm are integrally formed.

12. The golf club holder of claim 1 wherein the golf club holder is adapted to removably couple to said golf bag.

13. The golf club holder of claim 1 wherein the golf club holder is adapted to temporarily couple to said golf bag.

14. A golf club holder adapted to couple to a top portion of a golf bag to secure a least one golf club within a golf bag comprising:

a row of flutes, each flute having a top and an interior surface;

at least one magnet coupled to each interior surface; and the row of flutes is fastened to a golf club bag, the row of flutes comprises semicircular flutes, golf club supports and a horizontal arm that are integral.

15. The golf club holder of claim 14 whereby the golf club holder comprises a temporary fastening means.

16. The golf club holder of claim 14 whereby the golf club holder comprises a permanent fastening means.

17. The golf club holder of claim 14 wherein at least one magnet couples to the interior surface via Velcro.

18. The golf club holder of claim 14 wherein at least on magnet couples to the interior surface via adhesive.

* * * * *